US010361016B2

(12) United States Patent
Cao et al.

(10) Patent No.: US 10,361,016 B2
(45) Date of Patent: Jul. 23, 2019

(54) ELECTROLESS PLATING OF SILVER ONTO GRAPHITE

(71) Applicant: HENKEL IP & HOLDING GMBH, Duesseldorf (DE)

(72) Inventors: Jie Cao, Hillsborough, NJ (US); Wenhua Huang, Shanghai (CN); Allison Yue Xiao, Belle Mead, NJ (US)

(73) Assignee: HENKEL IP & HOLDING GMBH, Duesseldorf (DE)

( * ) Notice: Subject to any disclaimer, the term of this patent is extended or adjusted under 35 U.S.C. 154(b) by 0 days.

(21) Appl. No.: 14/302,845

(22) Filed: Jun. 12, 2014

(65) Prior Publication Data

US 2014/0295066 A1 Oct. 2, 2014

Related U.S. Application Data

(63) Continuation of application No. PCT/US2012/028251, filed on Mar. 8, 2012.

(60) Provisional application No. 61/576,077, filed on Dec. 15, 2011.

(51) Int. Cl.

| | |
|---|---|
| ***H01B 13/00*** | (2006.01) |
| ***H01B 1/02*** | (2006.01) |
| ***C23C 18/16*** | (2006.01) |
| ***C23C 18/18*** | (2006.01) |
| ***C23C 18/44*** | (2006.01) |

(52) U.S. Cl.

CPC ..... *H01B 13/0026* (2013.01); *C23C 18/1635* (2013.01); *C23C 18/1658* (2013.01); *C23C 18/1882* (2013.01); *C23C 18/1889* (2013.01); *C23C 18/44* (2013.01); *H01B 1/02* (2013.01)

(58) Field of Classification Search

CPC .. H01B 13/0026; H01B 1/02; C23C 18/1635; C23C 18/1658; C23C 18/1882; C23C 18/1889; C23C 18/44

USPC ..... 427/113; 252/503

See application file for complete search history.

(56) References Cited

U.S. PATENT DOCUMENTS

| | | | | |
|---|---|---|---|---|
| 4,379,129 | A * | 4/1983 | Abe | B01D 53/8675 250/324 |
| 6,387,542 | B1 | 5/2002 | Kozlov et al. | |
| 6,485,831 | B1 | 11/2002 | Fukushima et al. | |
| 7,713,340 | B2 | 5/2010 | Kawamura et al. | |
| 2002/0192379 | A1* | 12/2002 | Imori | C23C 18/1879 427/304 |
| 2004/0028859 | A1 | 2/2004 | LeGrande et al. | |
| 2006/0062717 | A1* | 3/2006 | Tokuoka | H01M 4/0402 423/448 |
| 2006/0233963 | A1* | 10/2006 | Imori | C23C 18/18 427/437 |
| 2009/0035562 | A1 | 2/2009 | Fukushima | |

FOREIGN PATENT DOCUMENTS

| | | | | |
|---|---|---|---|---|
| CN | 1624175 | A | | 6/2005 |
| CN | 1919933 | A | * | 2/2007 |
| CN | 1996644 | A | | 7/2007 |
| CN | 101054483 | A | * | 10/2007 |
| JP | 02173272 | A | | 7/1990 |
| JP | 2000204479 | A | | 7/2000 |
| JP | 2008133535 | A | | 6/2008 |
| WO | 0149898 | A1 | | 7/2001 |

OTHER PUBLICATIONS

CN 101054483 A, Espacenet Machine Translation, originally published 2007, p. 1-12.*

CN 101054483 A, ProQuest Machine Translation, originally published 2007, p. 1-20.*

CN 101054483 A, Derwent Summary, originally published 2007, p. 1-3.*

Knovel Critical Tables, "Basic Physical Properties of Chemical Compounds", 2008, p. 1-2.*

HyperPhysics, "Glucose", 2008, p. 1-4.*

Knovel Sampler, "Physical Constants of Inorganic Compounds", 2003, p. 1.*

ChemSpider, "3-Trimethoxysilyl)-1-propanamine" and "(3-Aminopropyl)triethoxysilane", 2015, p. 1-2.*

PubChem, "3-Aminopropyl methyl dimethoxy silane", 2015, p. 1.*

ChemNet, "3-Aminopropyl Methyldiethoxysilane", 2015, p. 1.*

Chen, G., Weng, W., Wu, D., Wu, C., Lu, J., Wang, P., Chen, X.; "Preparation and Characterization of Graphite Nanosheets from Ultrasonic Powdering Technique"; 2004; Carbon; 42, p. 753-759.*

CN191993 A. Espacenet Machine Translation, originally published 2007, p. 1-9.*

NIST, "N-(2-Aminoethyl)-3-aminopropyltrimethoxysilane", 2016, p. 1-2.*

Ash, M., Ash, I., "Specialty Chemicals—Source Book", 2009, Synapse Information Resources, Inc., 4th Ed., p. 239.*

Product Block, "N-(2-Aminoethyl)-3-aminopropyltriethoxysilane", 2016, p. 1-2.*

Schlesinger, M. "Electroless and Electrodeposition of Silver", 2010, Modern Electroplating, 5th Ed., John Wiley & Sons, p. 131-138.*

Aqion, "pH of Common Acids and Bases", 2016, p. 1-3.*

Sun, Weifu et al. "Electroless desposition of silver particles on graphite nanosheets." Scripta Materialia, Elsevier, 59, 2008, pp. 1031-1034.

(Continued)

*Primary Examiner* — Gordon Baldwin
*Assistant Examiner* — Christina D McClure
(74) *Attorney, Agent, or Firm* — Sun Hee Lehmann

(57) ABSTRACT

A one-pot process for the electroless-plating of silver onto graphite powder is disclosed. No powder pretreatment steps for the graphite, which typically require filtration, washing or rinsing, are required. The inventive process comprises mixing together three reactant compositions in water: an aqueous graphite activation composition comprising graphite powder and a functional silane, a silver-plating composition comprising a silver salt and a silver complexing agent, and a reducing agent composition.

8 Claims, No Drawings

(56) References Cited

OTHER PUBLICATIONS

Tongxiang, Liang et al. "Electroless plating of silver on graphite powders and the study of its conductive adhesive." International Journal of Adhesion & Adhesives, 28, 2007, pp. 55-58.
Lin, Wei et al. "Research of silver plating nano-graphite filled conductive adhesive" Synthetic Metals, Elsevier, 159, 2009, pp. 619-624.
Zhang, Yi et al. "Electrically conductive adhesive based on acrylate resin filled with silver plating graphite nanosheet" Synthetic Metals, 161, 2011, pp. 516-522.
N. Koura, Electroless Plating of Silver , Electroless Plating Fundamentals & Applications, 1985, Chapter 17, pp. 441 462 (no month avail.).
Schlesinger, M. "Electroless and Electrodeposition of Silver." Modern Electroplating Fifth Edition, John Wiley & Sons, Inc., 2010, pp. 131-138.

* cited by examiner

ELECTROLESS PLATING OF SILVER ONTO GRAPHITE

BACKGROUND OF THE INVENTION

This invention is related to the electroless plating of silver onto graphite powder.

Bulk silver continues to increase in cost, prompting the search for alternatives for use in the fabrication, for example, of semiconductors and electronic devices. Silver-plated copper is one of the best alternatives due to its excellent initial conductivity. However, copper lacks oxidative stability, which limits its use in applications requiring high reliability at high temperature and high humidity conditions. Moreover, silver-plated copper itself is relatively expensive. Silver-plated glass or any other silver-plated filler with an insulator core suffer low conductive performance, and are poor substitutes for silver or silver-plated copper.

Silver-coated graphite is lower in cost than, and can deliver comparable initial conductivity to, bulk silver or silver-plated copper, without the oxidative stability problems associated with copper. Current processes for preparing silver-coated graphite, however, suffer from production difficulties.

The surface of graphite is inert and must be pretreated before it can be plated in an electroless process. However, graphite pretreatment methods involve at least one of the following steps: oxidation, heating, or wet chemical activation, followed by powder separation, washing and rinsing. All these procedures lead to problems for large-scale manufacture.

Oxidation is effective to introduce active sites on graphite surfaces for plating, but typical oxidants, such as nitric acid, sulfuric acid, or hydrogen peroxide, require special operation procedures due to their corrosive or explosive nature. In addition, powder separation, washing and rinsing generate hazardous waste.

Heating is another method to generate active surfaces on graphite. However, heating requires special equipment, there is a narrow temperature window for operation, and it is difficult to reproduce results.

Typical wet activation methods involve the use of tin or similar metal compounds, along with a sensitizer, such as, palladium chloride in aqueous condition. After sufficient mixing, the graphite powder must be separated from the activation bath using numerous filtration, washing and rinsing steps, taking time and creating hazardous waste.

The current invention circumvents these problems.

SUMMARY OF THE INVENTION

This invention is a one-pot process for the electroless-plating of silver onto graphite powder. No powder pretreatment steps for the graphite, which typically require filtration, washing or rinsing, are required.

The inventive process comprises mixing together three reactant compositions in water. These can be added together simultaneously or in a combination of stages.

The first composition is an aqueous graphite activation composition comprising graphite powder and a functional silane. The functional silane interacts both with the graphite in this activation composition and with a silver salt that is a component of the silver-plating composition.

The second composition, a silver-plating composition, comprises a silver salt (which interacts with the functional silane) and a silver complexing agent. These can be provided as solids or in an aqueous solution.

The third composition, a reducing composition, comprises a reducing agent for the silver salt, which can be provided as a solid or in an aqueous solution.

DETAILED DESCRIPTION OF THE INVENTION

The aqueous graphite activation composition comprises graphite powder and a nitrogen-containing silane. The silane is either a siloxane or a silanol.

Graphite powder has a minor amount (in the ppm range) of oxygen associated on its surface; the oxygen is capable of interacting in aqueous conditions with the silane in the nitrogen-containing silane to form silanol groups by hydrolysis. This reaction anchors the nitrogen-containing silane to the graphite.

The nitrogen in the nitrogen-containing silane in turn will coordinate with the silver salt in the silver-plating composition. This coordination provides an activation or seeding site for plating silver on the whole graphite surface.

Exemplary nitrogen-containing silanes include 3-isocyanatopropyltri-ethoxysilane, 3-iso-cyanatopropyltrimethoxysilane, 2-cyanoethyltrimethoxy-silane; 2-cyanoethyltri-ethoxysilane, 3-cyanopropyltri-methoxysilane, 3-cyanopropyltriethoxysilane, 3-cyanopropylmethyldimethoxysilane, 3-aminopropyl-trimethoxy-silane, 3-aminopropyltriethoxysilane, 3-amino-propylmethyl-dimethoxysilane, 3-aminopropylmethyldiethoxysilane, 4-amino-butyltriethoxy-silane, N-(2-amino-ethyl)-3-aminopropyltrimethoxysilane, N-(2-aminoethyl)-3-aminopropyltriethoxy-silane, N-(2-aminoethyl)-3-aminopropylmethyldimethoxy-silane, aminopropyl-silanetriol, N-(2-aminoethyl)-3-amino-propylsilanetriol, aminophenyltrimethoxy-silane, 3-thiocyanato-propyltri-ethoxy-silane, and 3-(2-imidazolin-1-yl)propyltriethoxy-silane). Any of these can be used in combination with the others.

In one embodiment, the nitrogen-containing silane is present in the graphite activation composition in an amount of 0.01-20 weight % of graphite weight, preferably at 0.1-10 wt % of graphite weight.

The silver-plating composition comprises a silver salt and a silver complexing agent. In one embodiment, the silver salt is water soluble. Exemplary silver salts include silver nitrate, silver sulfate, and silver chloride. In one embodiment, the silver salt is silver nitrate.

The concentration of silver salt in the plating bath ranges from 0.01 to 50 g/L. In one embodiment, the silver salt concentration ranges from 2 to 30 g/L. In a further embodiment, the silver salt concentration ranges from 5 to 25 g/L.

Exemplary silver complexing agents include ammonium hydroxide, ethylenediamine, methylamine, and ethylamine. In one embodiment, the complexing agent is ammonium hydroxide in an aqueous solution within the range of 28 to 30 wt % (weight percent). The amount of 28 to 30 wt % ammonium hydroxide solution present in the plating bath ranges from 0.01 to 35 g/L; in one embodiment, from 1.4 to 20 g/L; in a further embodiment, from 3.5 to 18 g/L.

The silver-plating composition can be mixed in conjunction with the graphite activation composition or added separately, after the graphite composition is formed and mixed.

The reducing composition comprises a reducing agent for the silver salt. Exemplary reducing agents include aldehydes, polyols, tartrates, tartaric acid, monosaccharides, disaccharides, polysaccharides, hydrazine, hydrazine hydrate, and phenyl hydrazine.

In one embodiment, the reducing agent is formaldehyde (typically as a 37 wt % aqueous solution) and/or glyoxal (typically as a 40 wt % aqueous solution). In the embodiment in which the reducing agent is formaldehyde, the amount of 37 wt % aqueous formaldehyde solution present in the plating composition ranges from about 0.01 to 150 g/L; in another embodiment, from 1 to 100 g/L; in a further embodiment, from 5 to 50 g/L.

The reducing composition is added to the combination of the graphite activation composition and the silver-plating composition.

The use of a pH-control substance is optional. Exemplary pH control agents include KOH, NaOH, or any ammonium, nitrate, or borate salt.

The use of an organic co-solvent is optional. Exemplary co-solvents include alcohol, acetone, tetrahydrofuran (THF), ethyl acetate, and toluene.

The process of this invention comprises (A) mixing together in water the following compositions: (1) a graphite activation composition comprising graphite powder and a nitrogen-containing silane; (2) a silver-plating composition comprising a silver salt and a silver complexing agent; and (3) a reducing composition for the silver salt; and (B) isolating the resultant silver-coated graphite.

The components within each of the graphite activation and silver-plating compositions can be mixed together all at once, or they can be mixed in stages with a time delay between additions of the components for mixing to occur. (The reducing composition has only one component.) Mixing is typically accomplished by stirring at room temperature.

In one embodiment a portion of the silver salt that would make up the silver-plating composition is added to the graphite activation composition. This portion of the silver salt will be an amount within the range of 0.1 wt % to 10 wt % of the total graphite weight. In one embodiment, the silver salt is added to the graphite activation composition in an amount within the range of 1 wt % to 5 wt % of the total graphite weight. The silver-plating composition, less the amount of silver salt previously added to the graphite activation composition, is then added to the graphite activation composition and mixed. To this mixture is added the reducing composition for the silver salt.

The mixture of compositions is stirred together at a temperature sufficient to cause the silver salt to be reduced and plated onto the graphite. In the plating process containing formaldehyde solution, the preferred mixing temperature or range of mixing temperatures is within the range of 20° C. to 25° C. The typical reaction time is under one hour for laboratory quantities; however, longer times can be expected for commercial quantities.

Glyoxal is a possible substitute for formaldehyde; however, it is less reactive and requires a higher reaction temperature and longer mixing. A benefit is that it has less toxicity.

The graphite activation, silver-plating, and reducing compositions can be mixed together without any time delay between addition of the compositions to each other. In other embodiments the addition takes place sequentially so that the graphite activation composition is prepared first and mixed for a time; then the silver-plating composition (prepared and mixed) is added to the graphite activation composition. The graphite activation and silver-plating compositions are mixed for a time, after which the reducing composition (prepared and mixed) is added to the combination of the graphite activation and silver-plating compositions, and all three compositions are mixed. Mixing is typically accomplished by stirring at room temperature.

EXAMPLES

Example 1

The graphite activation composition and the silver-plating composition were prepared as one composition together, after which the reducing composition was added. The compositions were prepared and mixed at room temperature.

In a two liter beaker were added 3-isocyanatopropyltriethoxysilane (0.1 g), graphite (3 g), and an aqueous solution of silver ammonium nitrate containing silver nitrate (11 g), ammonium hydroxide (28 wt %, 9 g), and water (1000 mL). The mixture was stirred for 45 minutes at room temperature. To this was added with stirring a mixture of reducing agent containing formaldehyde (37 wt %) aqueous solution (10 g). Silver-coated graphite product was formed within 15 minutes and settled to the bottom of the reaction flask. The clear aqueous layer was decanted off and the silver-coated graphite product washed three times with 200 g of water each time, followed by drying at 120° C. overnight. The yield was above 95%.

Example 2

The graphite activation composition, containing a small amount of silver nitrate as a seeding compound, was prepared independently of the silver-plating composition. The compositions were prepared and mixed at room temperature.

In a two liter beaker were added 3-isocyanatopropyltriethoxysilane (0.1 g), silver nitrate (0.1 g), water (200 mL), graphite (3 g). The mixture was stirred for 30 minutes at room temperature. An aqueous silver plating solution containing silver nitrate (11 g) and ammonium hydroxide (28 wt %, 9 g) and water (800 mL) was added to the graphite mixture. The combined solutions were stirred for 15 minutes. To this was added with continued stirring a mixture of reducing agent containing formaldehyde (37 wt %) aqueous solution (10 g). Silver-coated graphite product was formed within 15 minutes and settled to the bottom of the reaction flask. The clear aqueous layer was decanted off and the silver-coated graphite product was washed three times with 200 g of water each time, followed by drying at 120° C. overnight. The yield was above 95%.

Example 3

A seed solution of silver nitrate was added to a prepared and stirred graphite activation composition. Subsequently, the silver-plating composition was added. The compositions were prepared and mixed at room temperature.

In a two liter beaker were added 3-isocyanatopropyltriethoxysilane (0.1 g), water (200 mL) and graphite (3.0 g). This mixture was stirred for 15 minutes at room temperature. An aqueous solution of silver nitrate (0.1 g) in water (10 mL) was added to the graphite mixture. Stirring was continued for 15 minutes, after which an aqueous silver plating solution containing silver nitrate (11 g), ammonium hydroxide (28 weight %, 9 g) and water (800 mL) was added with stirring to the graphite mixture for another 15 minutes at room temperature. To this was added with continued stirring a mixture of reducing agent containing formaldehyde (37 wt %) aqueous solution (10 g). Silver-coated graphite product was formed within 15 minutes and settled to the bottom of the reaction flask. The clear aqueous layer was decanted off and the silver-coated graphite product washed three times with 200 g of water each time, followed by drying at 120° C. overnight. The yield was above 95%.

Example 4. Comparative

In this example, a prior art multi-step electroless plating method is described as a conventional way of preparing silver-coated graphite material. The method includes the use of graphite activation, graphite sensitization, and plating baths. Moving from bath to bath requires separation of solution and powder product in order to minimize cross contamination of the baths.

In a 250 mL flask was added a graphite activation solution containing $SnCl_2.2H_2O$ (0.5 g), HCl (37 wt % solution) (0.3 g), water (100 mL) and graphite (3 g). This activation mixture was stirred for 30 minutes at room temperature; centrifuged to settle the graphite and the solution decanted off. The activated graphite mixture was washed once with 60 g water, and then added to a graphite sensitization bath containing $PdCl_2$ (0.05 g), HCl (37 wt % solution) (0.1 g) and water (100 mL). The sensitizing mixture was stirred for 30 minutes, centrifuged to settle the graphite, and the sensitization solution removed.

The sensitized graphite mixture was then washed with 200 g water followed by centrifugation until the solution pH reached between 5-6. An aqueous silver plating solution containing silver nitrate (11 g), ammonium hydroxide (28 wt %, 9 g) and water (1100 mL) was added with stirring to the sensitized graphite mixture. To this was added with continued stirring a mixture of reducing agent containing formaldehyde (37 wt %) aqueous solution (10 g). Silver-coated graphite product formed within 15 minutes and settled to the bottom of the reaction flask. The clear aqueous layer was decanted off and the silver-coated graphite product washed three times with 200 g of water each time, followed by drying at 120° C. overnight. The yield was above 95%.

Example 5. Conductivity Performance in Epoxy Formulations

Conductive adhesive formulations were prepared from each of the silver-coated graphite products from examples 1 to 4 using an epoxy resin (EPICLON 835 LV from DIC formally known as Dainippon Ink and Chemical) at a 32 volume % (vol %) loading of the silver-coated graphite, and one weight % (wt %) of 2-ethyl-4-methyl imidazole based on total weight.

Films of the formulations were cast on glass slides and cured at 175° C. for one hour in an air oven. The film dimensions were: length=75 mm, width=5 mm, thickness=0.1 mm.

Volume resistivity (VR) was tested using a four-probe testing method at room temperature. The resistivities were the following:

| Example | 1 | 2 | 3 | 4 |
|---|---|---|---|---|
| Method | One-pot | One-pot | One-pot | Multiple baths |
| VR in 32 vol % (epoxy) (ohm · cm) | 1.36E−03 | 1.34E−03 | 1.52E−03 | 3.21E−03 |

The results indicate that the one-pot electroless plating processes from examples 1-3 produce silver-coated graphite materials giving higher conductivity than those prepared from the conventional multiple-step process of example 4.

Example 6. Conductivity Performance in Acrylate Formulations

Conductive adhesive formulations were prepared from each of the silver-coated graphite products from examples 1 to 4 using an acrylate formulation at a 26 vol % loading of the silver-coated graphite (or about 60 wt % filler loading based on total weight).

The acrylate composition contained 49 wt % tricyclodecane dimethanol diacrylate, 46 wt % isobornyl methacrylate, and 5 wt % dicumin peroxide.

Films of the formulations were cast on glass slides and cured at 175° C. for one hour in an $N_2$ oven. The film dimensions were: length=75 mm, width=5 mm, thickness=0.1 mm.

Volume resistivity (VR) was tested using a four-probe testing method at room temperature. The resistivities were the following:

| Example | 1 | 2 | 3 | 4 |
|---|---|---|---|---|
| Method | One-pot | One-pot | One-pot | Multiple baths |
| VR in 26 vol % (acrylate) (ohm · cm) | 4.2E−03 | 1.6E−03 | 1.5E−03 | 1.4E−02 |

The results indicate that the one-pot electroless plating processes from examples 1-3 produce silver-coated graphite materials giving higher conductivity than those prepared from the conventional multiple-step process of example 4.

Example 7. Effect of Using Nitrogen-Containing Silane Activator

Silver-coated graphite samples (SCG) were prepared according to example 2 at various silver-loadings based on total SCG weight. For each selected silver-loading, a comparative SCG sample was also prepared without using a silane activator in the process.

Adhesive formulations were prepared using the silver-coated graphite (SCG) and its comparative sample. Adhesive resin was either an epoxy composition or an acrylate composition.

The epoxy compositions contained epoxy resin (EPICLON 835 LV from DIC formally known as Dainippon Ink and Chemical) with 2.5 wt % 2-ethyl-4-methyl-imidazole.

The acrylate compositions contained 49% tricyclodecane dimethanol diacrylate, 46 wt % isobornyl methacrylate, and 5 wt % dicumin peroxide.

The silane activator was 3-isocyanatopropyltri-ethoxylsilane (ICPTES).

Films of the formulations were cast on glass slides. The film dimensions were: length=75 mm, width=5 mm, thickness=0.1 mm.

The epoxy formulations were cured at 175° C. for one hour in an air oven.

The acrylate formulations were cured at 175° C. for one hour in an $N_2$ oven.

Volume resistivity (VR) was measured using a four-probe testing method at room temperature.

The results are set out in the following table and show suitable resistivity for commercial applications.

| Sample | Total % Ag in SCG | N-Silane (wt % of graphite) | VR for 60 wt % SCG in Epoxy (ohm · cm) | VR for 60 wt % SCG in Acryl (ohm · cm) |
|---|---|---|---|---|
| A | 30% | 3.3% | 9.5E−01 | 6.7E−02 |
| A (Comparative) | 30% | 0% | 1.5E+00 | 1.7E−01 |
| B | 40% | 3.3% | 2.0E−01 | 1.4E−02 |
| B (Comparative) | 40% | 0% | 2.0E+00 | 2.5E−01 |
| C | 70% | 3.3% | 2.2E−03 | 9.2E−04 |
| C (Comparative) | 70% | 0% | 1.4E−02 | 1.2E−02 |

The results also indicate that silver-coated graphite materials giving higher conductivity were produced when a nitrogen-containing silane activator (N-Silane) was used, compared to when no nitrogen-containing silane activator was used, in the one-pot electroless plating processes.

Example 8. Varying Nitrogen-Containing Silane Activators

Silver-coated graphite (SCG) samples were prepared according to example 2 with a nitrogen-containing silane activator as listed in the following table.

Conductive adhesive formulations were prepared from each of the silver-coated graphite samples using an epoxy resin (EPICLON 835 LV from DIC formally known as Dainippon Ink and Chemical) at a 26 vol % loading of the silver-coated graphite, and one wt % of 2-ethyl-4-methyl imidazole based on total weight.

Films of the formulations were cast on glass slides. The films had dimensions: length=75 mm, width=5 mm, thickness=0.1 mm.

The epoxy formulations were cured at 175° C. for one hour in an air oven.

Volume resistivity (VR) was measured using a four-probe testing method at room temperature.

The results are set out in the following table and show suitable resistivity for commercial applications.

| Sample | Total % Ag in SCG | N-Silane activator | N-Silane (wt % of graphite) | VR for 26 vol % SCG in Epoxy (ohm · cm) |
|---|---|---|---|---|
| A | 70% | None | 0% | 1.4E−02 |
| B | 70% | 3-isocyanato-propyl-triethoxysilane | 3.3% | 2.2E−03 |
| C | 70% | 3-cyano-propyl-triethoxysilane | 3.3% | 5.4E−03 |
| D | 70% | 3-amino-propyl-trimethoxysilane | 3.3% | 5.5E−03 |
| E | 70% | N-(2-aminoethyl)-3-aminopropyl-trimethoxysilane | 3.3% | 5.5E−03 |
| F | 70% | aminopropyl-silanetriol | 3.3% | 5.5E−03 |

The results also indicate that silver-coated graphite materials giving higher conductivity were produced when a nitrogen-containing silane activator was used compared to when no silane activator was used in the one-pot electroless plating process.

Example 9. Effect of Component Concentration on Plating Quality

Silver-coated graphite (SCG) samples were prepared according to example 2, and were formulated with different concentrations of silane activator, silver nitrate seed, silver nitrate in plating solution, and reducing agent.

Conductive adhesive formulations were prepared from each of the silver-coated graphite samples and an epoxy resin (EPICLON 835 LV from DIC formally known as Dainippon Ink and Chemical) at a 26 vol % loading of the silver-coated graphite, and one wt % of 2-ethyl-4-methyl imidazole based on total weight.

Films of the formulations were cast on glass slides. Films had dimensions: length=75 mm, width=5 mm, thickness=0.1 mm.

The epoxy formulations were cured at 175° C. for one hour in an air oven.

Volume resistivity (VR) was measured using a four-probe testing method at room temperature.

The results are set out in the following table and show suitable resistivity for commercial applications with variables in the formulation. The relatively lower amounts of N-silane activator appeared to give the better conductivity values compared to no activator or a higher amount of activator.

| Sample | Graphite in Plating Solution (g/L) | Total % Ag in SCG | N-Silane (wt % of graphite) | $AgNO_3$ seed (wt % of graphite) | $AgNO_3$ in Plating Solution (g/L) | $H_2CO$ (37%) in plating solution (g/L) | VR for 26 vol % SCG in Epoxy ohm · cm |
|---|---|---|---|---|---|---|---|
| A | 2.7 | 70% | 0% | 3.3% | 10 | 9 (1.9 × AgNO3 mole) | 1.4E−02 |
| B | 2.7 | 70% | 0.1% | 3.3% | 10 | 9 (1.9 × AgNO3 moles) | 5.6E−03 |
| C | 2.7 | 70% | 10% | 3.3% | 10 | 9 (1.9 × AgNO3 moles) | 2.2E−03 |
| D | 0.55 | 70% | 3.3% | 1.5% | 2 | 6 (6.3 × AgNO3 moles) | 3.9E−03 |
| E | 2.73 | 70% | 0.3% | 0.3% | 20 | 18 (1.9 × AgNO3 moles) | 9.6E−03 |

The invention claimed is:

1. A process for a one-pot electroless plating of silver on graphite comprising (A) mixing together in water the following compositions in one-pot to form a plating solution:

(1) a graphite activation composition comprising graphite powder and a nitrogen-containing silane, wherein the graphite powder is not pretreated by wet chemical activation, oxidation or heating, wherein the nitrogen-containing silane of the graphite activation composition is selected from the group consisting of 3-isocyanatopropyltriethoxysilane, 3-isocyanatopropyltrimethoxysilane, 2-cyano-ethyltrimethoxysilane; 2-cyanoethyl-triethoxysilane, 3-cyanopropyl trimethoxy-silane, 3-cyanopropyltriethoxysilane, 3-cyanopropylmethyldimethoxysilane, 3-aminopropyltrimethoxysilane, 3-aminopropyltriethoxysilane, 3-aminopropyl-methyldimethoxysilane, 3-aminopropylmethyldiethoxysilane, 4-aminobutyl-triethoxysilane, N-(2-aminoethyl)-3-aminopropyltrimethoxysilane, N-(2-amino-ethyl)-3-aminopropyltriethoxy-silane, N-(2-aminoethyl)-3-aminopropyl-methyldimethoxysilane, aminopropylsilanetriol, N-(2-aminoethyl)-3-aminopropyl-silanetriol, aminophenyltrimethoxysilane, 3-thiocyanatopropyl-triethoxysilane, 3-(2-imidazolin-1-yl)propyltriethoxysilane, and any combination of the above;

(2) a silver-plating composition comprising a silver salt and a silver complexing agent; and (3) a reducing composition comprising a reducing agent for the silver salt; and (B) isolating the resultant silver-coated graphite from the plating solution.

2. The process according to claim 1 in which the nitrogen-containing silane is present in an amount from 0.1 to 10 wt % of the graphite weight.

3. The process according to claim 1 in which the silver salt of the silver-plating composition is selected from the group consisting of silver nitrate, silver sulfate, and silver chloride; and in which the silver complexing agent of the silver-plating composition is selected from the group consisting of ammonium hydroxide, ethylenediamine, methylamine, and ethylamine.

4. The process according to claim 1 in which the silver salt is present in an amount of 0.01 to 50 g/L of the plating solution.

5. The process according to claim 4 in which the silver salt, 0.1%-10% of the total graphite, is added to the graphite activation composition before the graphite activation composition and the silver-plating composition are mixed.

6. The process according to claim 1 in which the reducing agent for the silver salt is selected from the group consisting of aldehydes, polyols, tartrates, tartaric acid, monosaccharides, disaccharides, polysaccharides, hydrazine, and hydrazine hydrate.

7. The process according to claim 1 in which the reducing agent for the silver salt is present in an amount of 1 to 50 times the moles of silver salt in the plating solution.

8. The process according to claim 1 in which the graphite activation composition further comprises silver salt in an amount of 0.1%-10% of the total graphite weight in the graphite activation composition.

* * * * *